US009896169B2

(12) United States Patent
Munson

(10) Patent No.: US 9,896,169 B2
(45) Date of Patent: Feb. 20, 2018

(54) LANDING WATERCRAFT BOAT HULL WITH PUSH KNEES AND SIDE BUMPER ASSEMBLIES

(71) Applicant: Jesse W Munson, Wooway, WA (US)

(72) Inventor: Jesse W Munson, Wooway, WA (US)

( * ) Notice: Subject to any disclaimer, the term of this patent is extended or adjusted under 35 U.S.C. 154(b) by 0 days.

(21) Appl. No.: 15/068,216

(22) Filed: Mar. 11, 2016

(65) Prior Publication Data

US 2016/0272288 A1 Sep. 22, 2016

Related U.S. Application Data

(60) Provisional application No. 62/131,991, filed on Mar. 12, 2015.

(51) Int. Cl.

| | |
|---|---|
| ***B63B 59/02*** | (2006.01) |
| ***B63B 35/66*** | (2006.01) |
| ***B63B 27/14*** | (2006.01) |
| *B63B 21/56* | (2006.01) |
| *B63B 35/00* | (2006.01) |
| *B63H 20/00* | (2006.01) |

(52) U.S. Cl.

CPC ..... *B63B 59/02* (2013.01); *B63B 27/143* (2013.01); *B63B 35/66* (2013.01); *B63B 2021/563* (2013.01); *B63B 2035/001* (2013.01); *B63H 2020/003* (2013.01)

(58) Field of Classification Search

CPC ..... B63B 27/143; B63B 59/00; B63B 59/02; B63B 2059/025; B63B 21/56; B63B 2021/563; B63B 21/64; B63B 35/66; B63B 35/70

See application file for complete search history.

(56) References Cited

U.S. PATENT DOCUMENTS

| | | | | |
|---|---|---|---|---|
| 1,981,182 A * | 11/1934 | Lyons | B63B 59/02 114/219 |
| 2,341,866 A | 2/1944 | Higgins | |
| 2,799,494 A * | 7/1957 | Pollock | B63B 59/02 104/30 |
| 6,928,944 B2 * | 8/2005 | Stoll | B63B 21/56 114/219 |

(Continued)

FOREIGN PATENT DOCUMENTS

| | | | | |
|---|---|---|---|---|
| GB | 1402735 A * | 8/1975 | ..... | B63B 27/143 |

*Primary Examiner* — Andrew Polay
(74) *Attorney, Agent, or Firm* — Dean Craine

(57) ABSTRACT

A landing watercraft boat hull with push knees and side bumper assemblies that include a vertical rigid frame aligned parallel to the hull's longitudinal axis. The rigid frame's front edge extends in front of the bow of the hull. Attached to the rigid frame's top edge and extending over the rigid frame's front edge is an L-shaped front bumper. In one embodiment there are two assemblies located on opposite sides of a landing door. The rigid frames are sufficient in length so the front edges of the two L-shaped bumpers are disposed in front of the bow enabling the hull to safely push against other hulls or objects and protect the landing door. Attached to the outside surface of each rigid frame is a rigid shell cover that extends rearward from the rigid frame. The cover includes a rear opening in which the distal end of a side bumper attached to the side of the hull is inserted to hold and protect the distal end of the side bumper.

5 Claims, 6 Drawing Sheets

(56) References Cited

U.S. PATENT DOCUMENTS 8,721,224 B2 * 5/2014 Hough ..... E02B 3/26
114/219
9,555,865 B2 * 1/2017 Hansen ..... B63B 43/14

* cited by examiner

LANDING WATERCRAFT BOAT HULL WITH PUSH KNEES AND SIDE BUMPER ASSEMBLIES

This application is based on and claims the filing date benefit of U.S. Provisional patent application (Application No. 62/131,991) filed on Mar. 12, 2015.

BACKGROUND OF THE INVENTION

1. Field of the Invention

This invention relates to extension arms for a vehicle used to push other objects that protect the pushing vehicle against impacts and more particularly to such extension arms used on a landing watercraft boat hull with a forward extending loading door and protective side bumpers collars.

2. Description of the Related Art

Landing watercraft boat hulls typically include a rigid landing door that covers a landing door opening formed on the bow. The landing door is longitudinally aligned on the hull and configured to swing forward and downward to form a ramp for loading and unload cargo and passengers from the boat. The landing door, the hinge mechanism and the door opening must be protected so a tight seal is maintained around the landing door and the door opening formed on the hull when the landing door is closed.

Operators of landing watercraft who participate in sea rescue and patrol activities sometimes find it desirable to use their watercraft to push other boats or objects. Because the front edge of the hull on a typically landing watercraft is straight, the watercraft are not used as a pushing vehicle because of the unpredictable movement of the landing watercraft and the boat or objects in rough seas or high wind that may cause damage to the boats or objects and cause personal injury. Even in calm seas or light winds, operators are reluctant to use their watercraft to push boats or other objects because of the potential damage that may be done to the hull's landing door and door opening at the front edge of the hull.

Because landing watercrafts are temporarily positioned or moored against other boats or docks, they often include built-in side bumpers along the gunwales on the port and starboard sides. The side bumpers usually begin at the stern and extend the entire length of the hull and terminate near the front edge of the bow. The front ends of the side bumpers near the front edge of the bow are especially susceptible to being snagged or torn by other boats or docks.

What is needed is a landing watercraft hull with a forward extending landing door with securely attached pushing elements that extend forward from the hull that allow the hull to be used to push boats or other objects and to protect the landing door and door against impacts when the hull is used to push against other boats or objects. What is also needed is a holder that protects the front edges of the side bumpers that terminate near the front edge of the hull from being snagged, torn or disconnected from the bow.

SUMMARY OF THE INVENTION

These and other objects of the invention are met by a landing watercraft boat hull with a front, axially aligned landing door and at least two forward extending push knees on opposite sides of the door opening. Each push knee includes a vertical rigid frame securely mounted or welded to the bow of the hull. The rigid frame is aligned parallel to and located laterally equal distances from the boat hull's longitudinal axis. The rigid frame includes a top edge, an intermediate curved section, a front edge, a flat inside surface and a flat outside surface.

The boat hull is either a mono hull with two forward projecting hull sections or a catamaran hull with two forward extending forks. Both hull designs include a flat span deck that varies in size and shape depending on the type of hull and the hull size. A forward extending square or rectangular-shaped landing door is pivotally mounted along its lower edge to hinges located near the sides of the hull or near the front edge of the span deck.

The rigid frame is a plate-like structure vertically aligned with the hull's vertical axis. The center axis of the rigid frame is approximately aligned with the top deck so that its upper portion extends above the gunwale or deck and its lower portion extends below the gunwale or deck. The rigid frame's front edge is vertically aligned and substantially perpendicular to the hull's longitudinal axis. The rigid frame's curved intermediate section and front edge extend forward ahead of the top edge of the landing door at least 12 inches depending on the size of the hull. Attached to and extending over the rigid frames top edge, curved section and the front edge is a complimentary-shaped front bumper.

Mounted on or attached to the outside surface of the rigid frame is a rearward extending side bumper receiver that includes a rigid shell cover that extends laterally and rearward from the rigid frame. The front edge of the shell cover is integrally formed or mounted to the rigid frame and includes a rear opening configured to receive the distal end of a side bumper that extends longitudinally over the sides of the hull. During assembly, the distal end of the side bumper is inserted into rear opening.

Mounted inside the shell cover adjacent to the rear opening are optional upper and lower clips that engage upper and lower grooves commonly found on side bumpers. During assembly, the upper and lower clips engage the upper and lower grooves to securely hold the distal end of the side bumper inside the shell cover.

DESCRIPTION OF THE PREFERRED EMBODIMENT(S)

Figure 1:
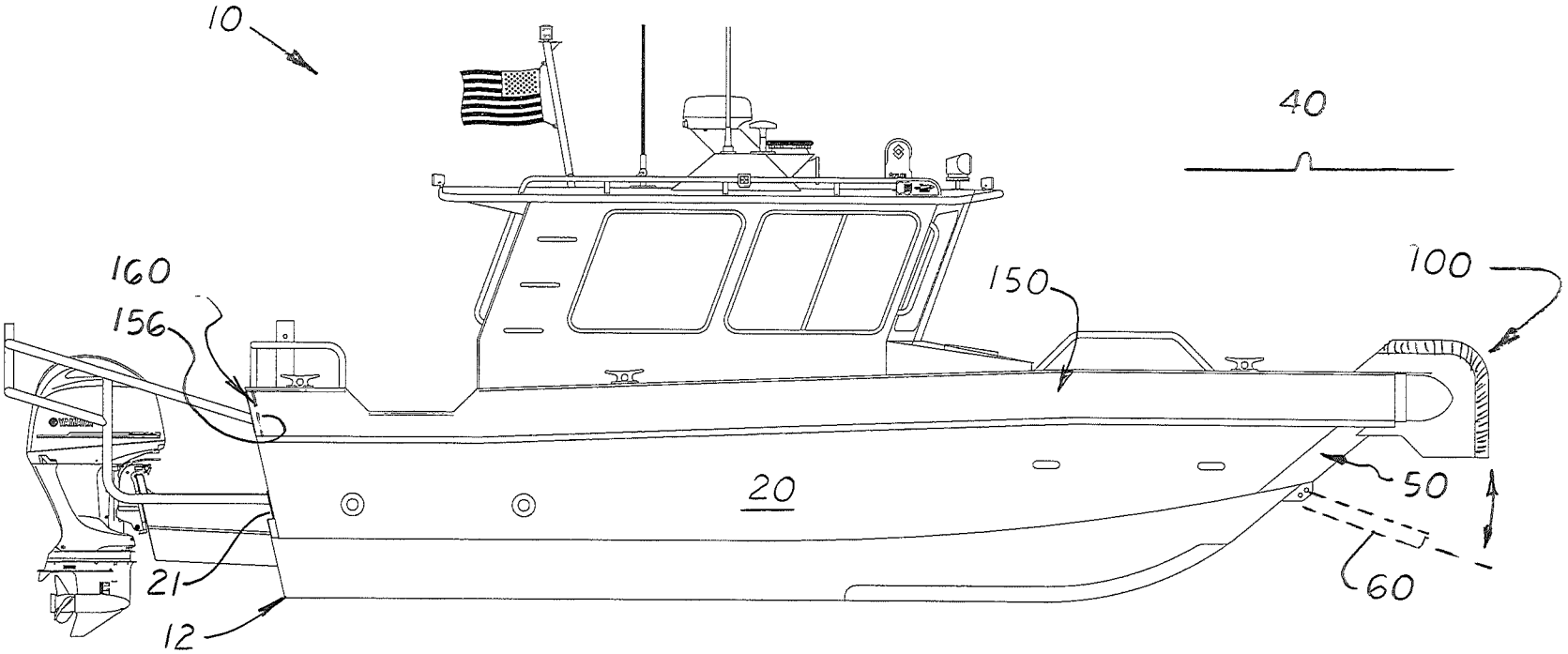
FIG. 1 is a side elevational view of a landing water craft that includes a hull with a front landing door, two integrated or mounted, forward extending push knees, and two full extending side collars that connect to conical shell covers formed on each push knee.
Figure 2:
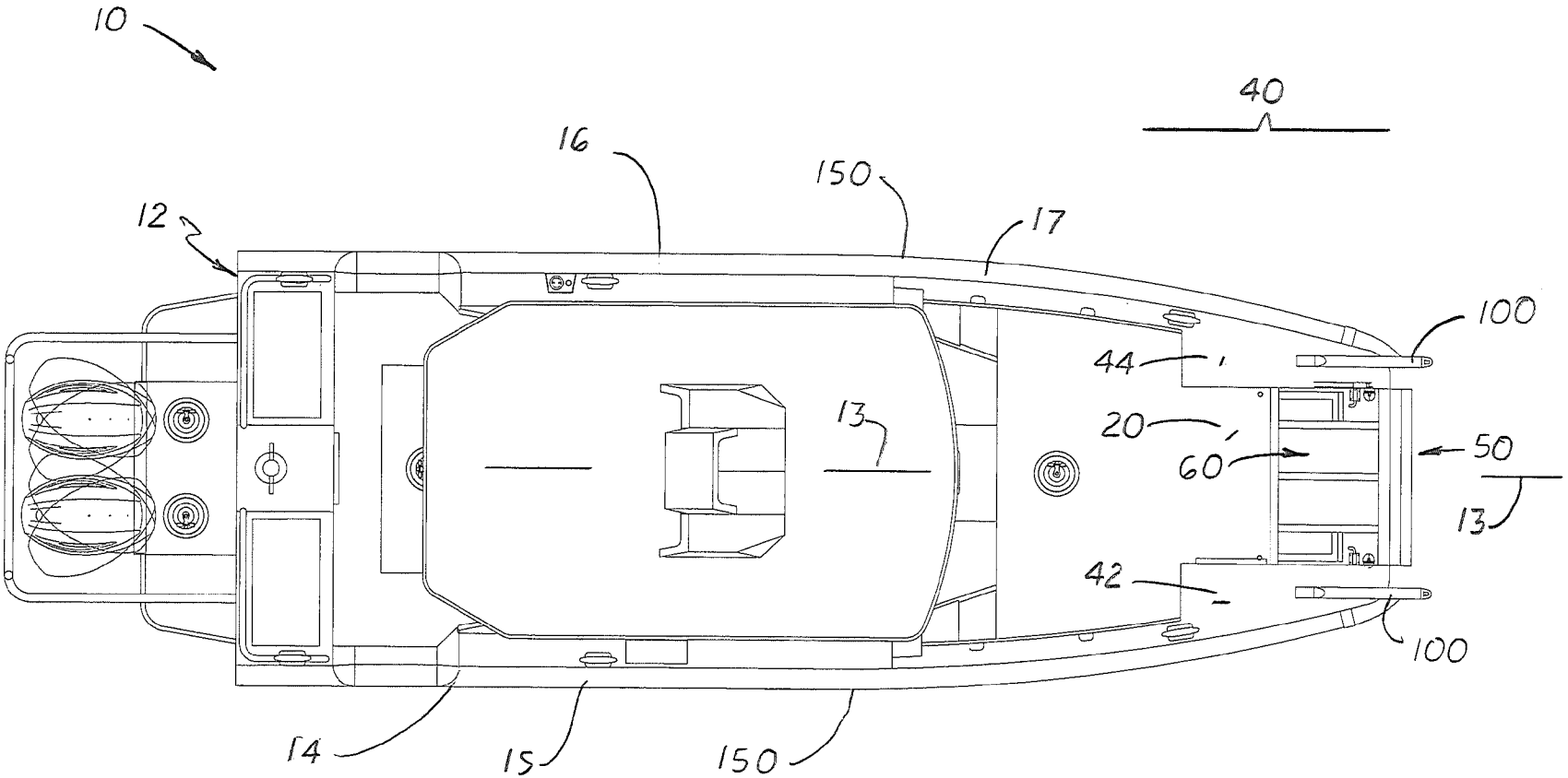
FIG. 2 is a top plan view of the landing water craft shown in FIG. 1.
Figure 3:
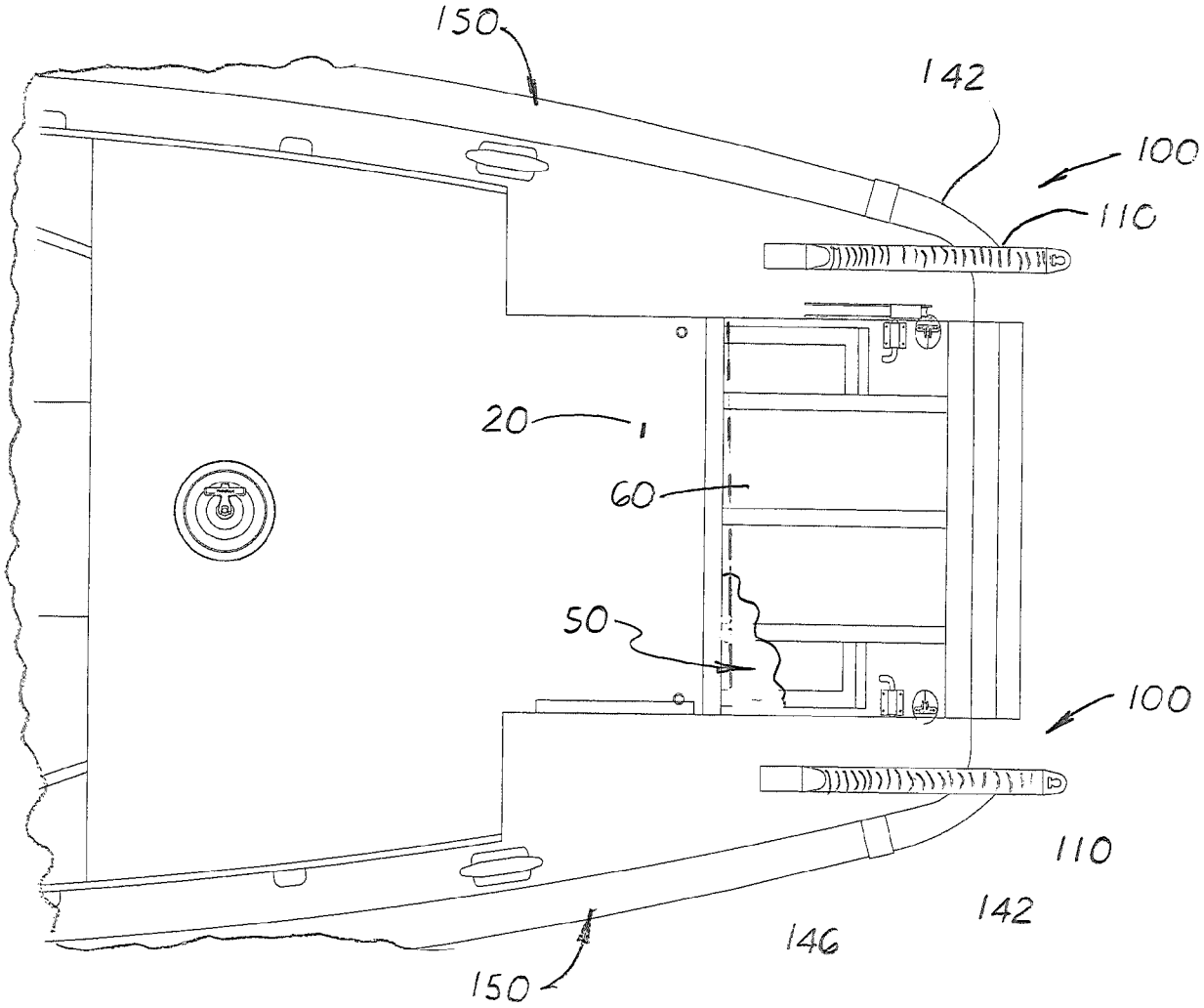
FIG. 3 is a partial, top plan view of the bow of the hull shown in FIGS. 1 and 2.
Figure 4:
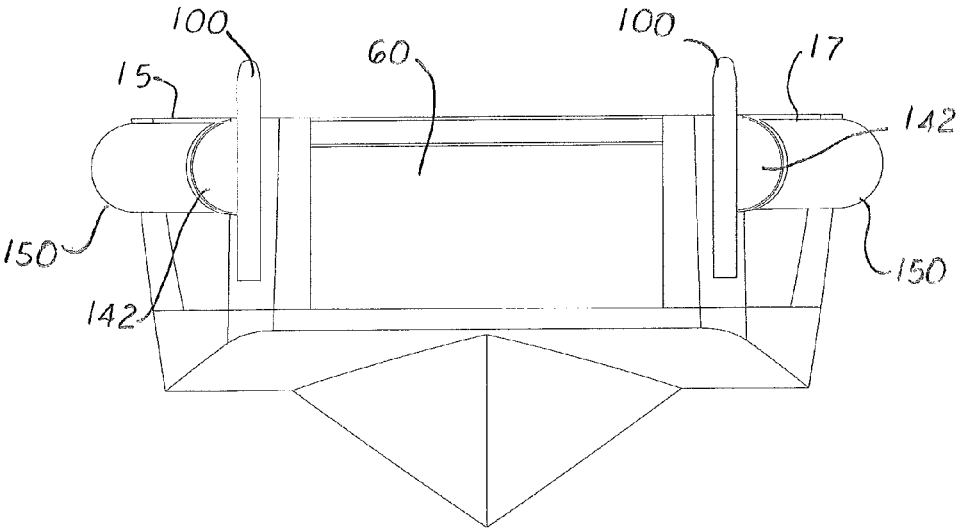
FIG. 4 is a front elevational view of the bow shown in FIGS. 2 and 3.
Figure 5:
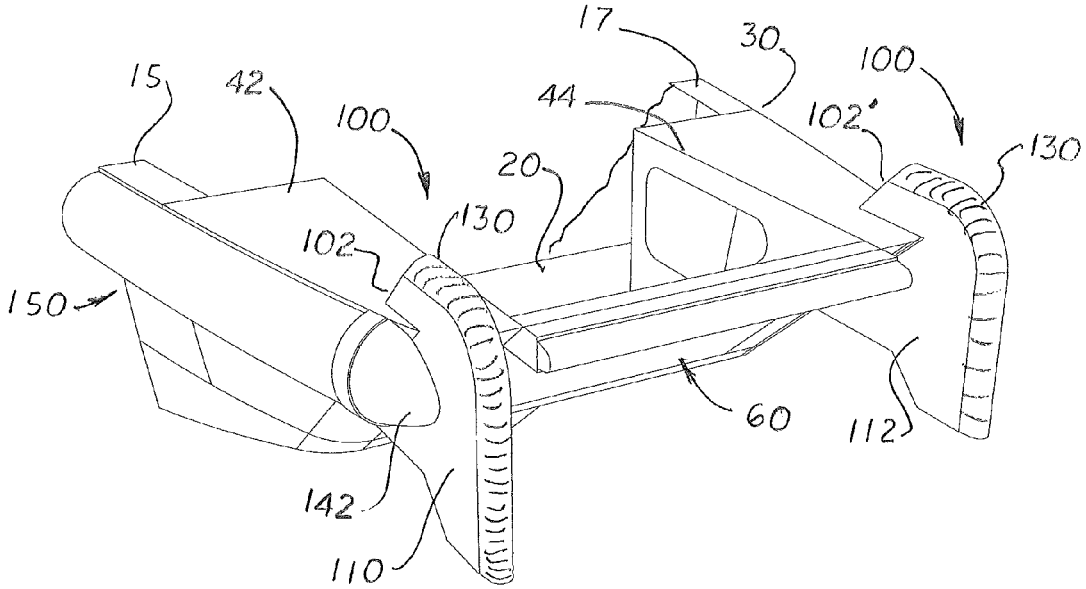
FIG. 5 is a perspective view of the bow shown in FIGS. 3 and 4.
Figure 6:
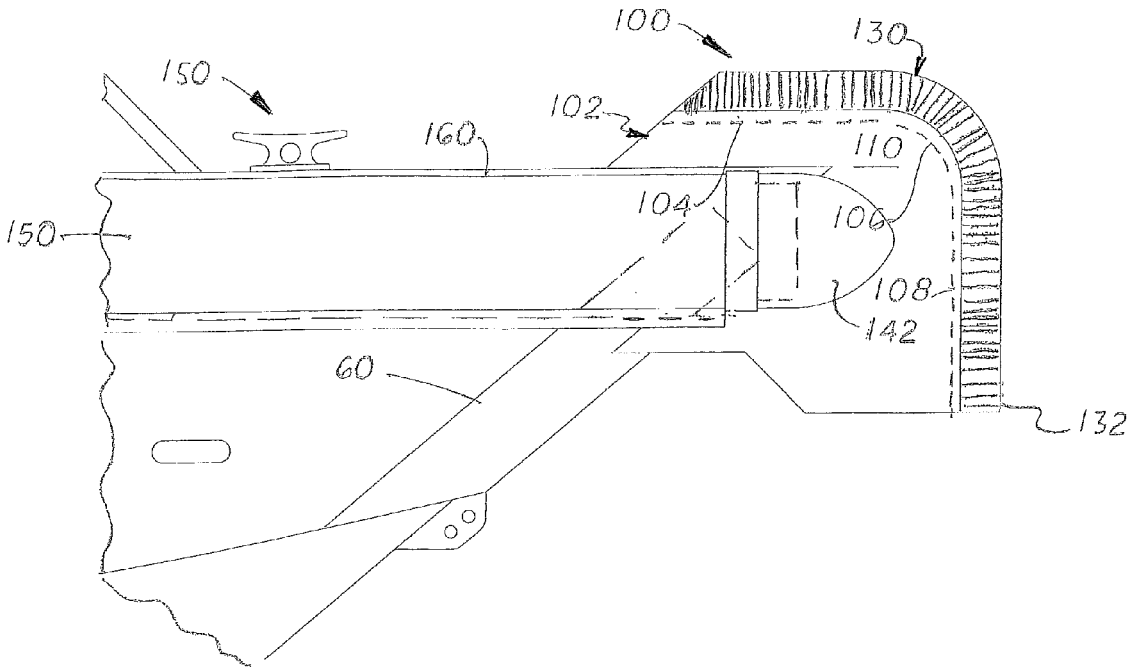
FIG. 6 is an enlarged, side elevational view of the bow showing the push knee and the distal end of a side collar interconnecting.

There is shown in the accompanying FIGS. 1-7 and is a watercraft 10 that includes a landing watercraft boat hull 12 with a front landing opening 50 formed on the bow 40 with a pivoting landing door 60 that closes over the landing opening 50 formed on a span deck 20 located between two front bow sections 42, 44. Formed or attached to the bow 40 are two forward extending push knees 100 that extend from the front edge of the bow 40 on opposite sides of the hull's longitudinal axisl3, (see FIG. 2).

Figure 8:
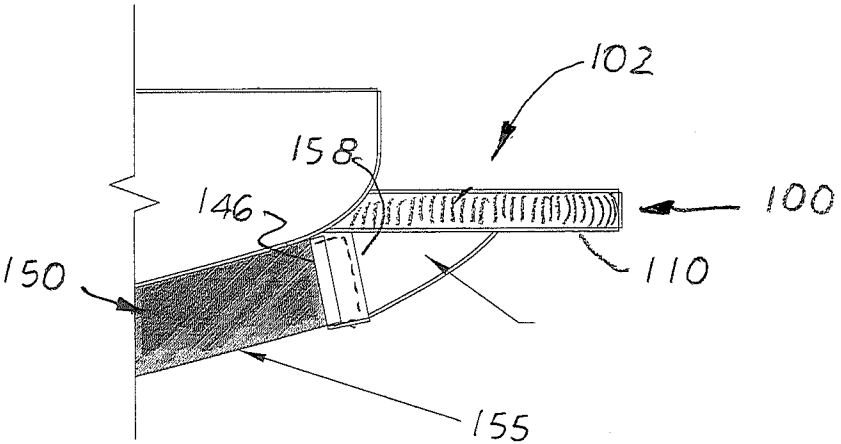
FIG. 8 is a partial top plan view of one push knee and one collar.

The two push knees 100 are mirror images of each other and aligned vertically and parallel. As shown more clearly in FIGS. 5, 6 and 8, each push knee 100 includes a vertical rigid frame 102 that has a flat top edge 104, a curved top/front edge 106, a vertical front edge 108, a planar outside surface 110, and a planar inside surface 112. The rigid frame 102 is positioned on the hull 12 to that its top edge is located above the gunwale 15 or 17 four to twelve inches and the vertical front edge 108 is sufficient in length so its lower edge extends below the gunwale 15 or 17 four to twelve inches. Attached to the rigid frame's top edge 104 and extending over the top/front edge 106, and the vertical front edge 108 is an L-shaped front bumper 130. The vertical leg 132 of the front bumper 130 is disposed in front of the front edge of the bow 40 and is sufficient in length to enable the hull 12 to safely push against other hulls or objects without contacting the upper edge of the landing door 60 when the landing door 60 is closed.

Figure 7:
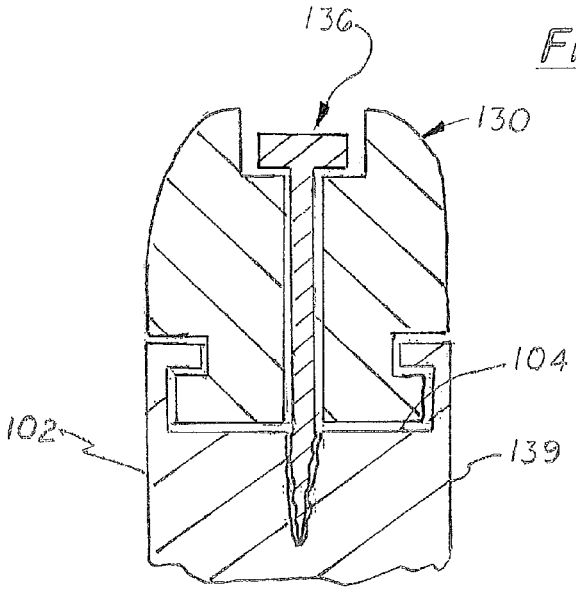
FIG. 7 is a sectional side elevational view of the L-shaped front bumper attached to rigid frame.

As shown in FIG. 7, the front bumpers 130 are attached to the top edges 104 of the rigid frames 102 via countersunk threaded connectors 136 that connect to threaded bores 139 formed on the rigid frames 102.

Figure 9:
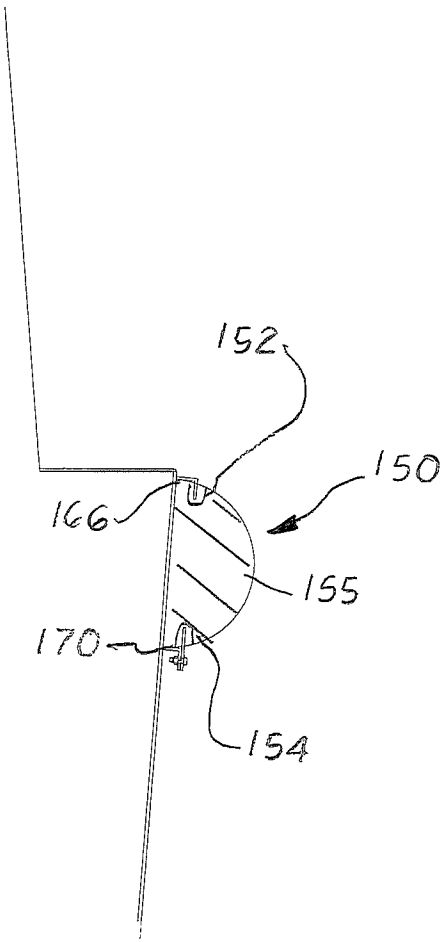
FIG. 9 is a sectional side elevational view of the collar mounted on the side of the hull just below the gunwale.

The hull 12 also includes two elongated side bumpers 150 mounted on the hull's starboard and port sides 14, 16 and slightly below the gunwales 15 and 17, respectively. In the embodiment shown in FIG. 9, each side bumper 150 includes a one-half spherical outer surface 152 with a flat inside surface 154. During assembly, the inside surface 154 is placed against the outside surface of the side of the hull 12. Each side bumper 150 includes an upper longitudinally aligned upper groove 152 and a lower groove 154. The proximal end 156 of the side bumper 150 attaches to a receiver clip 160 mounted near the stern 21 as shown in FIG. 1.

Attached to the outside surface 110 of each rigid frame 102 is a side bumper receiver 140 that includes a rigid shell cover 142 that extends laterally and diagonally rearward from the rigid frame 102. The shell cover 142 includes a rear opening 146 in which the distal end 158 of a side bumper 150 is inserted to hold and protect the distal end 158 and thereby prevent detachment. The shell cover 142 is aligned approximately to the rigid frame's midline axis so that rear opening 146 is aligned with the side bumper 130.

Located adjacent to or inside the rear opening 146 is an upper L-shaped clip 166 and a lower clip 170. The clips 166 and 170 are attached to the outside surface of the hull and spaced apart a sufficient distance to engage upper and lower grooves 152, 154 formed on the side bumpers 150 to securely hold them inside the rear opening 146.

The push knees 100 are made of steel or aluminum welded or connected to the hull 12. The shell covers 142 are also made of steel or aluminum welded or connected to the outside surface of the rigid frames 102. The shell covers 142 are approximately 4 to 8 inches in length.

In embodiment shown in the drawings, the watercraft hull 12 is 22 to 36 feet in length and 9 to 10 feet in width. The span deck 20 is approximately 3 to 5 feet in width and 1 to 3 feet in length. The landing door 60 is approximately 3 to 5 feet in length and 3 to 5 feet width. The push knees 100 are approximately 2 to 3 feet in length. The top edges 104 of the rigid frame 102 are approximately 6 to 8 inches above the gunwale. The front edges 108 extends approximately 6 to 18 inches in front of the hull 12. The side bumpers 150 are approximately 8 inches in width and approximately 20 to 34 feet in length.

Using the above described push knees 100, a method for protecting the landing door 60 on a landing watercraft boat hull 12 and holding the distal end of a side bumper 150 attached to the side of the watercraft boat hull 12 is disclosed, comprising the following steps:

a. selecting a two forward extending push knees 100 configured to be attached on said hull and located on opposite sides of said landing door opening 50, each said push knee 100 includes a rigid frame 102 that includes a top edge 104, a front edge 106, an outside surface 110 and an inside surface 112, each said push knee 100 also includes a front bumper 130 that extends over said front edge 106 of said rigid frame 102 , said rigid frame 102 and said front edge 106 configured to extend forward from said bow of said boat hull to protect said landing door against impacts, each said rigid frame 102 also includes a shell cover 142 formed on or mounted to said outside surface 110 of said rigid frame 102, said shell cover 142 extends laterally and diagonally rearward from the rigid frame 102 when said rigid frame 102 is attached to said bow, said shell cover 142 includes a rear opening 146;

b. attaching said push knees 100 to said hull 12, said push knees 100 are aligned with said rigid frames 102 aligned vertical and parallel and spaced apart on opposite sides of said landing door 60 and with said shell covers 142 extends laterally and diagonally rearward from the rigid frame 102; and, c. inserting the distal end 152 of each said side bumper 150 into said rear opening 146 formed on said shell cover 142.

In compliance with the statute, the invention described has been described in language more or less specific as to structural features. It should be understood, however, that the invention is not limited to the specific features shown, since the means and construction shown comprises the preferred embodiments for putting the invention into effect. The invention is therefore claimed in its forms or modifications within the legitimate and valid scope of the amended claims, appropriately interpreted under the doctrine of equivalents.

I claim:

1. A landing watercraft hull, comprising:

a. mono hull or catamaran hull each with a stern, a bow and a port side and a starboard side, said port side and said starboard side each has a gunwale, said bow includes a planar front span deck and a transversely aligned front landing door opening;

b. a landing door attached to said bow and configured to pivot and open or close said landing door opening;

c. at least two forward extending push knees attached or formed on said bow of said hull and located on opposite sides of said landing door opening, each said push knee includes a rigid frame with a top edge, a front edge, an outside surface, and an inside surface, each said push knee also includes a bumper that extends over said front edge of said rigid frame, said rigid frame and said bumper configured to extend forward from said bow of said hull to protect said landing door against impacts;

d. a shell cover formed on or mounted to said outside surface of said rigid frame, said shell cover extends laterally and diagonally rearward from said rigid frame when said rigid frame is attached to said bow, said shell cover includes a rear opening; and, e. one elongated side bumper that extends longitudinally over said port side and said starboard side of said hull and adjacent to said gunwale, each said side bumper includes a distal end configured to fit into said rear opening formed on said shell cover formed or attached to said rigid frame on the same side of said bow.

2. The landing watercraft hull, as recited in claim 1 further including an upper clip and a lower clip configured to engage said side bumper when said distal end is inserted into said rear opening.

3. A combination push knee and side bumper holder for a landing watercraft hull with side bumpers attached to port and starboard sides of said hull, said holder comprising: a rigid frame that includes a top edge, a front edge, an outside surface and a shell cover formed on or mounted to said outside surface of said rigid frame, said shell cover extends laterally and diagonally rearward from said outside surface of said rigid frame when said rigid frame is vertically and axially aligned on said hull and includes a rear opening that receives and covers an end of said side bumper attached to said hull, said push knee and side bumper holder also includes an elastic bumper that extends over said top edge and said front edge of said rigid frame.

4. The push knee and side bumper holder, as recited in claim 3, further including an upper groove and a lower groove formed on said side bumper and an upper clip and a lower clip attached to said hull that engage said upper groove and said lower groove, respectively, and hold said end of said side bumper inside said rear opening of said shell cover.

5. A method of protecting the landing door on a landing watercraft that includes a hull with a landing door located at the bow and holding the distal end of a side bumper attached to the side of the watercraft, comprising the following steps:

a. selecting two forward extending push knees configured to be attached to said hull and located on opposite sides of said door opening, each said push knee includes a rigid frame that includes a top edge, a front edge, an outside surface and an inside surface, each said push knee also includes a bumper that extends over said front edge of said rigid frame, said rigid frame and said bumper configured to extend forward from said bow of said hull to protect said landing door against impacts, each said rigid frame also includes a shell cover formed on or mounted to said outside surface of said rigid frame, said shell cover extends laterally and diagonally rearward from the rigid frame when said rigid frame is attached to said bow, said shell cover includes a rear opening:

b. attaching said push knees to said bow of said watercraft, said push knees are aligned so that said rigid frames are aligned vertical and parallel and spaced apart on opposite sides of said landing door and said shell cover extends laterally and diagonally rearward from said rigid frame; and c. inserting the distal end of each said side bumper into said rear opening formed on said shell cover.

* * * * *